US006644182B1

(12) United States Patent
Chen

(10) Patent No.: US 6,644,182 B1
(45) Date of Patent: Nov. 11, 2003

(54) METHOD OF PRODUCING CONE DIAPHRAGM HAVING COLOR PATTERNS

(76) Inventor: Chui-Che Chen, No. 73, Jong Yeong Rd., Nan Twen Chiu 408, Taichung (TW)

( * ) Notice: Subject to any disclaimer, the term of this patent is extended or adjusted under 35 U.S.C. 154(b) by 0 days.

(21) Appl. No.: 10/251,998

(22) Filed: Sep. 23, 2002

(51) Int. Cl.[7] ..... B41F 17/00

(52) U.S. Cl. ..... 101/35; 101/483; 101/171; 101/494; 442/169; 381/388; 381/428; 381/432; 264/103; 264/132; 181/167; 181/170; 181/173

(58) Field of Search ..... 264/132, 103, 264/129, 136, 137, 134; 381/432, 428, 388; 181/167, 170, 173; 101/35, 483–94, 171

(56) References Cited

U.S. PATENT DOCUMENTS

| | | | | | |
|---|---|---|---|---|---|
| 3,253,970 | A | * | 5/1966 | Williams | 156/228 |
| 3,768,590 | A | * | 10/1973 | Yocum | 181/167 |
| 4,639,283 | A | * | 1/1987 | Nakamura | 156/89.13 |
| 4,705,527 | A | * | 11/1987 | Hussamy | 8/558 |
| 5,319,718 | A | * | 6/1994 | Yocum | 381/398 |
| 5,458,958 | A | * | 10/1995 | Kanzaki et al. | 442/338 |
| 5,632,943 | A | * | 5/1997 | Lin | 264/103 |
| 5,650,105 | A | * | 7/1997 | Yocum | 264/45.5 |
| 5,888,626 | A | * | 3/1999 | Sensenig | 428/206 |
| 5,903,658 | A | * | 5/1999 | Okazaki et al. | 381/428 |
| 5,998,309 | A | * | 12/1999 | Hesler | 442/169 |
| 6,243,478 | B1 | * | 6/2001 | Tsao | 381/388 |
| 6,334,504 | B1 | * | 1/2002 | Sato et al. | 181/167 |

FOREIGN PATENT DOCUMENTS

| | | | | | |
|---|---|---|---|---|---|
| JP | 01144897 | A | * | 6/1989 | H04R/9/00 |
| JP | 02011328 | A | * | 1/1990 | B41F/19/08 |
| JP | 02060727 | A | * | 3/1990 | B29C/47/08 |
| JP | 09163488 | A | * | 6/1997 | H04R/7/02 |

* cited by examiner

*Primary Examiner*—Andrew H. Hirshfeld
*Assistant Examiner*—Andrea Hence Evans
(74) *Attorney, Agent, or Firm*—Troxell Law Office PLLC

(57) ABSTRACT

A method of producing cone diaphragm having color patterns includes steps of using a fiber-made thin sheet as a base material; printing the base material with a high molecular ink; soaking the printed base material in a high molecular resin material; or alternatively, first soaking the base material in the high molecular resin material and drying the base material, and then printing the base material wish the high molecular ink; so that the base material is coated with a layer of the high molecular resin to maintain a desired brilliance of the color patterns; drying the base material and positioning it in a high-temperature mold, so that the base material is molded into a cone having a predetermined shape; painting outer surfaces of the molded cone with a paint; and trimming the molded and painted cone to produce a finished cone diaphragm having color patterns.

4 Claims, 3 Drawing Sheets

METHOD OF PRODUCING CONE DIAPHRAGM HAVING COLOR PATTERNS

BACKGROUND OF THE INVENTION

A currently available cone diaphragm is an oscillating member in the form of a cone made of a thin sheet material. The cone diaphragm is used on a loudspeaker to transmit sound through vibration thereof. That is, when a sound is produced and transmitted to the cone diaphragm to vibrate it, the sound is effectively transmitted and received by a listener.

Most cone diaphragms are made of a fiber material, such as pulp fiber, fiberglass, carbon fiber, etc. To produce the cone diaphragm, first pre-form a sheet material from such fiber material and position the sheet material in a mold, so that the sheet material is molded into a cone with a predetermined shape. The molded cone is then properly dried and trimmed to produce a finished product of cone diaphragm. The conventional cone diaphragm produced in the above-described method does not include any changeful and color pattern or texture on its outer surfaces to show an aesthetic and elegant appearance. Such conventional cone diaphragm having monotonous appearance fails to satisfy nowadays consumers who pursuit for changes and high quality in all kinds of products. It is therefore desirable to develop an improved cone diaphragm to meet most consumers' requirements.

SUMMARY OF THE INVENTION

A primary object of the present invention is to provide a method of producing a cone diaphragm having color patterns to create additional aesthetics and elegant quality for the cone diaphragm.

To achieve the above and other objects, the method of the present invention for producing cone diaphragm having color patterns includes steps of using a fiber-made sheet as a base material; printing the base material with a high molecular ink to show predetermined color patterns; soaking the printed base material in a high molecular resin material; or alternatively, first soaking the base material in the high molecular resin material and drying the base material, and then printing the base material with the high molecular ink; so that the base material is coated with a layer of the high molecular resin to maintain a desired brilliance of the color patterns; drying the base material and positioning it in a high-temperature mold, so that the base material is molded into a cone having a predetermined shape; painting outer surfaces of the molded cone with a paint; and trimming the molded and painted cone to produce a finished cone diaphragm with color patterns.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
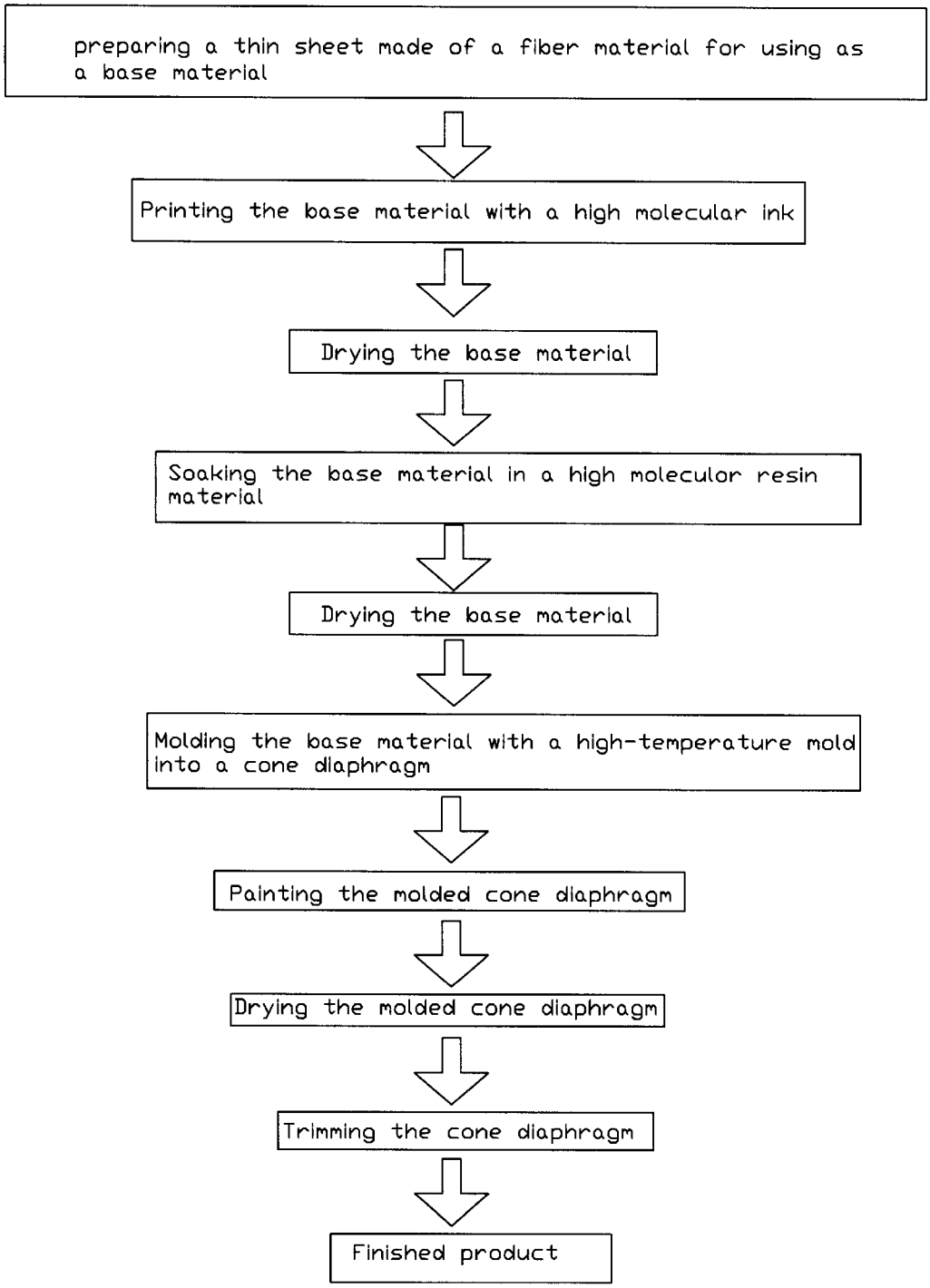
FIG. 1 is a block diagram showing steps included in the method of the present invention for producing a cone diaphragm having color patterns.

Please refer to FIG. 1 that is a block diagram showing steps included in the method of the present invention for producing a cone diaphragm having color patterns.

Figure 2:
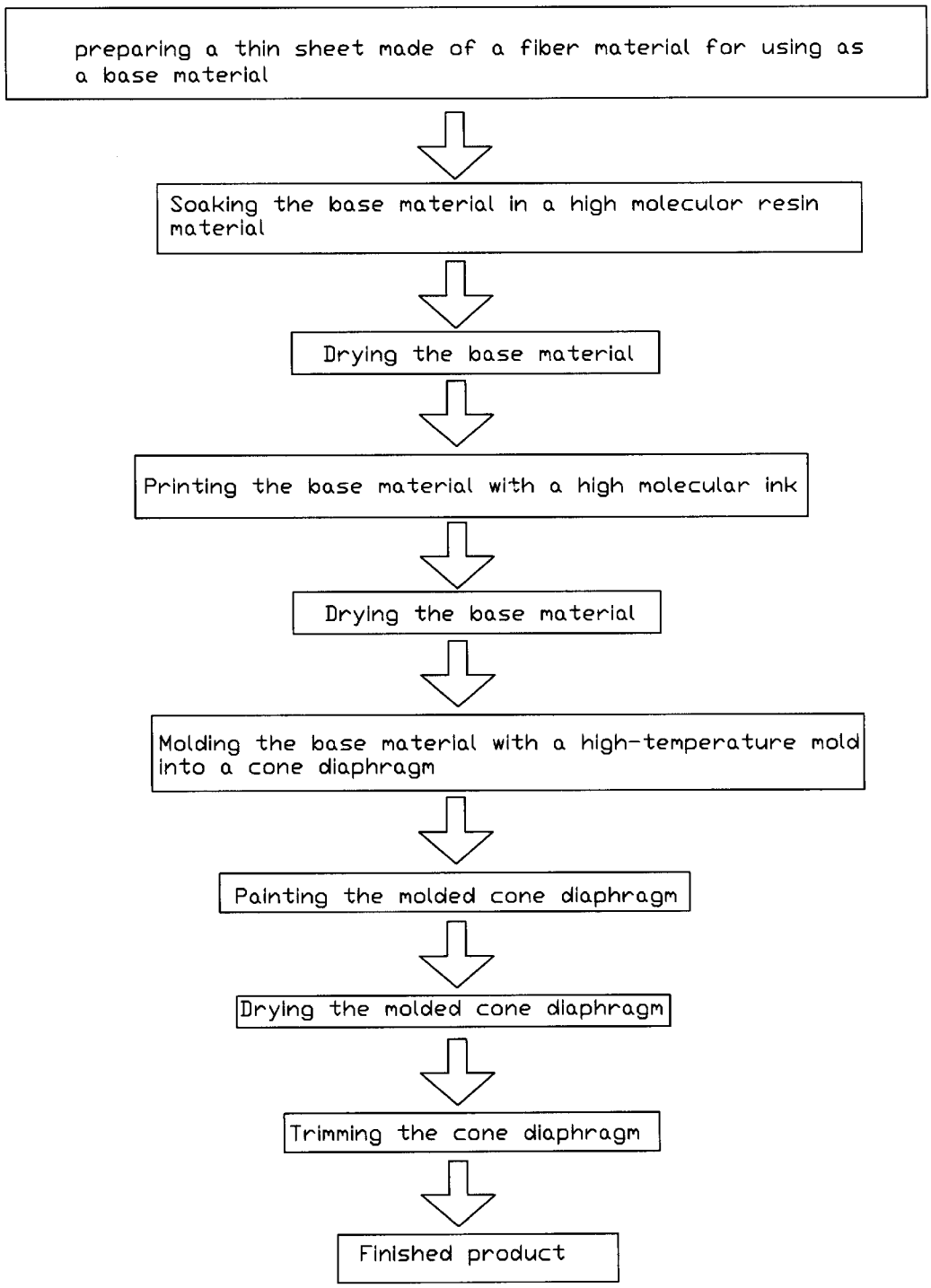
FIG. 2 is a block diagram showing alternative steps included in the method of the present invention.
Figure 3:
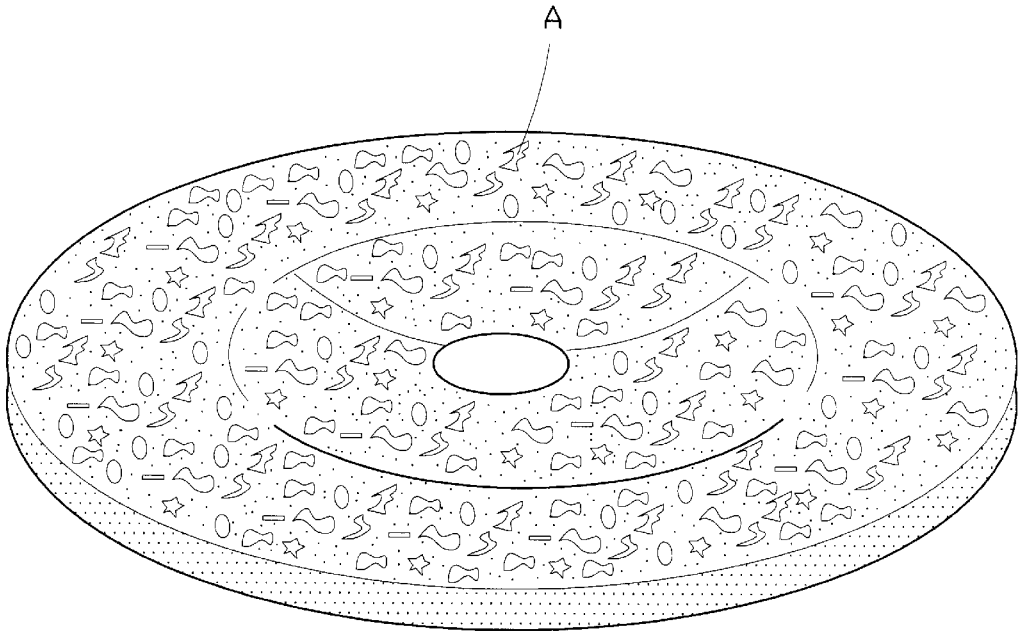
FIG. 3 is an example of the cone diaphragm having color patterns produced in the method of the present invention.

In the method of the present invention, a thin sheet made of a fiber material, such as fiberglass, KEVLAR, carbon fiber, NORMEX, etc., is used as a base material to make the cone diaphragm. The base material of fiber-made thin sheet is printed with a high molecular ink by way of, for example, halftone screen printing, cylinder printing, spray printing, transfer, etc., for the high molecular ink to associate with the fiber-made base material while showing predetermined color patterns on the base material. The base material with printed color patterns is then soaked in ah high molecular resin material, so that the base material is coated with a layer of high molecular resin. Or, in the method of the present invention, as shown in FIG. 2, it is also possible to first soak the base material in the high molecular resin material and dry the base material, and then print the base material with the high molecular ink. The base material coated with the high molecular resin is dried at 40° C.–120° C. for about 5 to 60 minutes, or air dried for about one hour for the high molecular resin material to effectively attach to the base material and effectively combine with the high molecular ink, in order to maintain the color patterns in a desired brilliance. The base material is then positioned in a high-temperature mold of 120° C.–200° C. for about 1 to 15 minutes, in order to be molded into a cone having a predetermined shape. The molded cone is painted at outer surfaces with a layer of desired paint and then dried at 40° C.–80° C. for about 10 to 60 minutes by way of UV radiation or air-drying. The dried cone is then trimmed to produce a finished product of cone diaphragm, on outer surfaces of which delicate color patterns A are formed at the same time, as shown in FIG. 3, creating an esthetic and elegant feeling for the finishing cone diaphragm. Finally, the finished cone diaphragm may be optionally coated with a layer of painting and dried at 40° C.–80° C. for about 10 to 60 minutes, so that the produced cone diaphragm has an increased gloss over its outer surfaces.

What is claimed is:

1. A method of producing a cone diaphragm having color patterns, which comprise the steps of:

a) selecting a base material of thin sheet fiber material;

b) printing a layer of high molecular ink over the base material to produce predetermined color patterns on the base material;

c) soaking the printed base material in a high molecular resin material to coat the base material with a layer of the high molecular resin;

d) drying the resin coated and printed base material to attach the high molecular ink with the base material;

e) molding the dried base material in a high-temperature mold to form a molded cone having a predetermined shape;

f) coating surfaces of the molded cone with a layer of paint;

g) drying the molded and painted cone; and h) trimming the dried cone to produce a finished product.

2. A method of producing a cone diaphragm having color patterns, which comprise the steps of:

a) selecting a base material of thin sheet fiber material;

b) soaking the printed base material in a high molecular resin material to coat the base material with a layer of the high molecular resin;

c) printing a layer of high molecular ink over the base material to produce predetermined color patterns on the base material;

d) drying the resin coated and printed base material to attach the high molecular ink with the base material;

e) molding the dried base material in a high-temperature mold to form a molded cone having a predetermined shape;

f) coating surfaces of the molded cone with a layer of paint;

g) drying the molded and painted cone; and h) trimming the dried cone to produce a finished product.

3. The method according to claim 1, wherein the trimming step h) further comprises the step of coating the trimmed cone with a layer of paint and drying the trimmed and painted cone.

4. The method according to claim 2, herein the trimming step h) further comprises the step of coating the trimmed cone with a layer of paint and drying the trimmed and painted cone.

* * * * *